US008430602B2

(12) United States Patent
Xu et al.

(10) Patent No.: US 8,430,602 B2
(45) Date of Patent: Apr. 30, 2013

(54) SYSTEM FOR INCREASED FLOATATION AND STABILITY ON TENSION LEG PLATFORM BY EXTENDED BUOYANT PONTOONS

(75) Inventors: Qi Xu, Katy, TX (US); Michael Y. H. Luo, Bellaire, TX (US); Steven Barras, Katy, TX (US); James O'Sullivan, Houston, TX (US)

(73) Assignee: TECHNIP France, Courbevoie (FR)

( * ) Notice: Subject to any disclaimer, the term of this patent is extended or adjusted under 35 U.S.C. 154(b) by 228 days.

(21) Appl. No.: 12/683,077

(22) Filed: Jan. 6, 2010

(65) Prior Publication Data

US 2011/0164927 A1 Jul. 7, 2011

(51) Int. Cl.
*B63B 35/44* (2006.01)

(52) U.S. Cl.
USPC ..... 405/223.1; 405/203; 405/224

(58) Field of Classification Search ..... 405/203, 405/204, 223.1, 224, 224.2; 114/265
See application file for complete search history.

(56) References Cited

U.S. PATENT DOCUMENTS

| | | | | |
|---|---|---|---|---|
| 3,540,396 | A | 11/1970 | Horton | |
| 3,982,492 | A | 9/1976 | Steddum | |
| 4,844,659 | A | 7/1989 | Hunter et al. | |
| 5,038,702 | A * | 8/1991 | Bowes | 114/265 |
| 5,330,293 | A | 7/1994 | White et al. | |
| 5,421,676 | A | 6/1995 | Wybro et al. | |
| 5,931,602 | A | 8/1999 | Gulbrandsen et al. | |
| 6,447,208 | B1 | 9/2002 | Huang et al. | |
| 6,884,003 | B2 * | 4/2005 | Horton, III | 405/224.2 |
| 7,033,115 | B2 * | 4/2006 | Huang et al. | 405/206 |
| 2005/0013666 | A1 | 1/2005 | Chianis et al. | |
| 2006/0086305 | A1 * | 4/2006 | Merchant et al. | 114/265 |
| 2007/0201954 | A1 * | 8/2007 | Leverette et al. | 405/224 |
| 2010/0290838 | A1 * | 11/2010 | Shelley et al. | 405/223.1 |

FOREIGN PATENT DOCUMENTS

| | | |
|---|---|---|
| WO | 9520074 | 7/1995 |
| WO | 0103999 | 1/2001 |

OTHER PUBLICATIONS

JPT Online, "New design criteria near completion for GOM operators," Official Publication of The Society of Petroleum Engineers, Jun. 1, 2007, [retrieved from the Internet on Jan. 6, 2010 using <URL: http://www.spe.org/jpt/2007/06/newdesign-criteria-near-completion-for-gom-operators>].

(Continued)

*Primary Examiner* — David Bagnell
*Assistant Examiner* — Benjamin Fiorello
(74) *Attorney, Agent, or Firm* — Locke Lord LLP

(57) ABSTRACT

The disclosure provides a tension leg platform ("TLP") with a plurality of buoyant pontoons suitable for highly disturbed seas that can expand the stability of the tension leg platform by extending at least one buoyant pontoon beyond an intersection of two pontoons. In at least one embodiment, the location of the column can be decoupled from the customary end of the pontoon. The tendons can be located at the ends of the pontoons extending beyond the intersection. In some embodiments, such as four-column TLPs, the pontoons can be extended orthogonally relative to an adjacent pontoon. The extending pontoon increases a buoyancy of the pontoon, increases a pitch stability of the TLP, and increases quayside stability. The extended pontoon can be structurally intersected with the adjacent pontoon to strengthen the extended pontoon and reduce the failure mode of such structure.

9 Claims, 5 Drawing Sheets

OTHER PUBLICATIONS

Murray, J., Yang, C.K., Yang, W., Krishnaswamy, P. and Zou, J., "An Extended Tension Leg Platform Design for Post-Katrina Gulf of Mexico," Paper No. ISOPE-2008-287, International Society of Power Engineers, [retrieved from the Internet on Jan. 6, 2010 using <URL: http://www.floatec.com/images/pr_content/ISOPEMurray-287.pdf>].

Adrezin, R. and Benaroya, H., "Response of a tension leg platform to stochastic wave forces," Probabilistic Engineering Mechanics, vol. 14, 1999, pp. 3-17.

Herbst, L., Acting Regional Director—United States Department of the Interior—Minerals Management Service—Gulf of Mexico OCS Region, "Assessment of Existing OCS Platforms and Related Structures for Hurricane Conditions," Notice to Lessees and Operators of Federal Oil, and Gas Leases and Pipeline Right-of-Way Holders in the Outer Continental Shelf (OCS), Gulf of Mexico OCS Region, NTL No. 2007-G27, [retrieved from the Internet on Jan. 6, 2010 using <URL: http://www.gomr.mms.gov/homepg/regulate/regs/ntls/2007NTLs/07-g27.pdf.

Gardel, A., International Search Report for International Patent Application No. PCT/US2010/061694, European Patent Office, dated Mar. 17, 2011.

Gardel, A., Written Opinion for International Patent Application No. PCT/US2010/061694, European Patent Office, dated Mar. 17, 2011.

* cited by examiner

SYSTEM FOR INCREASED FLOATATION AND STABILITY ON TENSION LEG PLATFORM BY EXTENDED BUOYANT PONTOONS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates generally to a system and method for offshore floating structures for use in the oilfield and related industries for exploration and extraction of minerals and resources from below surface waters. More specifically, the disclosure relates to a system and method for tension leg platforms for offshore exploration and production.

2. Description of the Related Art

With the significantly increasing demand on the oil and gas supply, offshore exploration and production from reservoirs has become vital to such supply. These reservoirs usually require large drilling rig and drilling variable payload which result in very large topsides in both size and weight. Spars and Tension Leg Platforms ("TLPs") are the only two proven dry tree hull forms in water depths below 1524 m (5,000 ft). Each design has advantages.

A Spar platform is a type of floating oil platform typically used in very deep waters and is among the largest offshore platforms in use. A Spar platform includes a large cylinder or hull supporting a typical rig topsides. The cylinder however does not extend all the way to the seafloor, but instead is moored by a number of mooring lines. Typically, about 90% of the Spar is underwater. The large cylinder serves to stabilize the platform in the water, and allows movement to absorb the force of potential high waves, storms, or hurricanes. Low motions and a protected center well also provide an excellent configuration for deepwater operations. In addition to the hull, the Spar's three other major parts include the moorings, topsides, and risers. Spars typically rely on a traditional mooring system to maintain their position. Spars can be used in any suitable depth of water and are especially suited for deep water and ultra deep water.

A Tension-Leg Platform ("TLP") or Extended Tension Leg Platform (ETLP) is a vertically moored floating structure normally used for the offshore production of oil or gas, and is currently suited for water depths less than 1500 meters (about 4900 ft). The hull is a buoyant structure with a topsides deck at its top that supports the exploration and/or production operations of extracting minerals, including oil and gas, and can include living quarters. Pontoons and columns provide sufficient buoyancy to maintain the deck above the waves during all predicted sea states. The platform is permanently moored by means of tendons (also known as tethers or tension legs) coupled at each of the structure's corners. These tendons are drawn tight and pull the floating TLP downward to a depth, such that the buoyancy of the TLP maintains tension on the tendons, such that virtually all vertical motion of the platform is eliminated, creating a "stiff" structure. This stiffness allows the platform to have the production wellheads on deck (connected directly to the subsea wells by rigid risers), instead of on the seafloor. The relative fixed vertical position allows a simpler well completion and gives better control over the production from the oil or gas reservoir, and easier access for downhole intervention operations.

The typical TLP couples the spacing of the columns to a supporting pontoon structure underneath the columns. The columns are coupled at the intersection of the several pontoons at the corners, forming the pontoon structure. The intersection creates a substantially rigid structural base to couple the columns. A plurality of tendons downwardly project from this intersection. To provide the needed stability to wave and wind motion, the columns are spaced apart to meet certain design criteria. However, the spacing required for the stability of the structure is often not required for support of the topsides deck on the column. Thus, the cost and extra weight of the structure can increase.

In 2005, two large hurricanes, Katrina and Rita, occurring within one month of each other in the Gulf of Mexico, United States, caused a significant loss of life, loss of platforms, and loss of production. Hurricane Katrina was the costliest hurricane, as well as one of the five deadliest, in the recorded history of the United States. Hurricane Rita hit one month later and was the fourth most intense Atlantic hurricane to hit the United States. The design criteria used at that time for offshore platforms had not predicted such stress loading on many of the existing platforms. The hurricanes destroyed over one hundred offshore platforms and damaged many others. In at least one instance of a floating TLP, the tendons ripped loose from the anchors or simply broke on one or more corners, leaving the remaining tendons taught, and causing the platform to overturn and capsize. As a result, the American Petroleum Institute and the industry in general revised its criteria for design analysis in this region for metocean criteria in the Gulf of Mexico and require additional stability and resistance to adverse movement under varying weather conditions.

U.S. Pat. No. 6,447,208 attempts to address increased stability of a TLP by adding radial wings or arms to the structure. These radial wings or arms are aligned with a vertical axis center point of the TLP and extend outwardly along a radian from each column. The patent discloses an extended-base tension leg substructure, where the substructure includes a plurality of support columns disposed about a central axis of the substructure and interconnected by at least one pontoon. Each column comprises an above water and a submerged portion. The substructure also includes a plurality of wings or arms radiating from the columns and/or the pontoons, each wing fixedly or removably securing at least one tendon extending from a wing to an anchor on the seabed. However, it is believed that the design of such radial wings form a discontinuous transition and are at a non-parallel angle with the pontoons and can create a failure mode between the radial wing and the pontoon assembly or adjacent column.

There remains a need for a different system and method for a TLP with increased stability.

BRIEF SUMMARY OF THE INVENTION

The disclosure provides a tension leg platform ("TLP") with a plurality of buoyant pontoons suitable for highly disturbed seas that can expand the stability of the tension leg platform by extending at least one buoyant pontoon beyond an intersection of two pontoons. In at least one embodiment, the location of the column can be decoupled from the customary end of the pontoon. The tendons can be located at the ends of the pontoons extending beyond the intersection. In some embodiments, such as four-column TLPs, the pontoons can be extended orthogonally relative to an adjacent pontoon. The extending pontoon increases a buoyancy of the pontoon, increases a pitch stability of the TLP, and increases quayside stability. The extended pontoon can be structurally intersected with the adjacent pontoon to strengthen the extended pontoon and reduce the failure mode of such structure.

The disclosure provides a system for increased stability on a tension leg platform comprising: a deck adapted to support extraction of minerals for an offshore tension leg platform; a column coupled with the deck; and a buoyant pontoon base of the tension leg platform coupled with the column and comprising a plurality of pontoons intersecting each other at a plurality of intersections, the pontoons extending past the intersections to form a plurality of pontoon extension portions at one or more of the intersections, the pontoon extension portions being adapted to be coupled to one or more tendons extending between the pontoon extension portions and a supporting surface below the pontoon extension portions.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The disclosure provides a tension leg platform ("TLP") with a plurality of buoyant pontoons suitable for highly disturbed seas that can expand the stability of the tension leg platform by extending at least one buoyant pontoon beyond an intersection of two pontoons. In at least one embodiment, the location of the column can be decoupled from the customary end of the pontoon. The tendons can be located at the ends of the pontoons extending beyond the intersection. In some embodiments, such as four-column TLPs, the pontoons can be extended orthogonally relative to an adjacent pontoon. The extending pontoon increases a buoyancy of the pontoon, increases a pitch stability of the TLP, and increases quayside stability. The extended pontoon can be structurally intersected with the adjacent pontoon to strengthen the extended pontoon and reduce the failure mode of such structure.

Figure 1A:
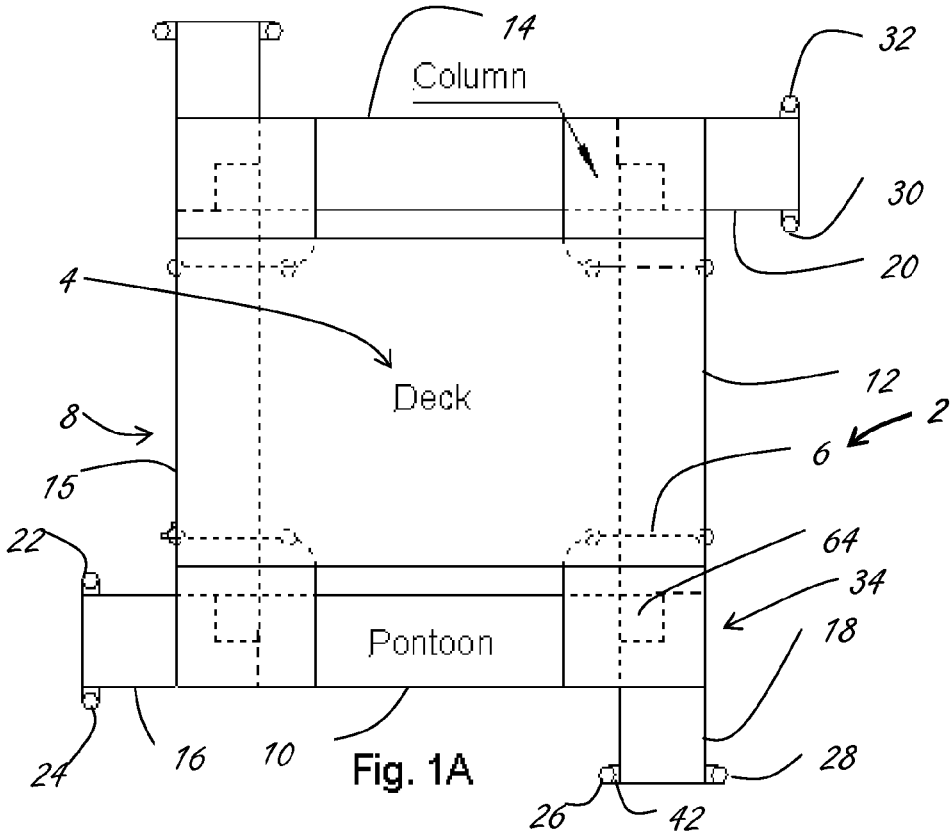
FIG. 1A is a schematic top view of an embodiment of the tension leg platform, illustrating pontoon extension portions for pontoons.
Figure 1B:
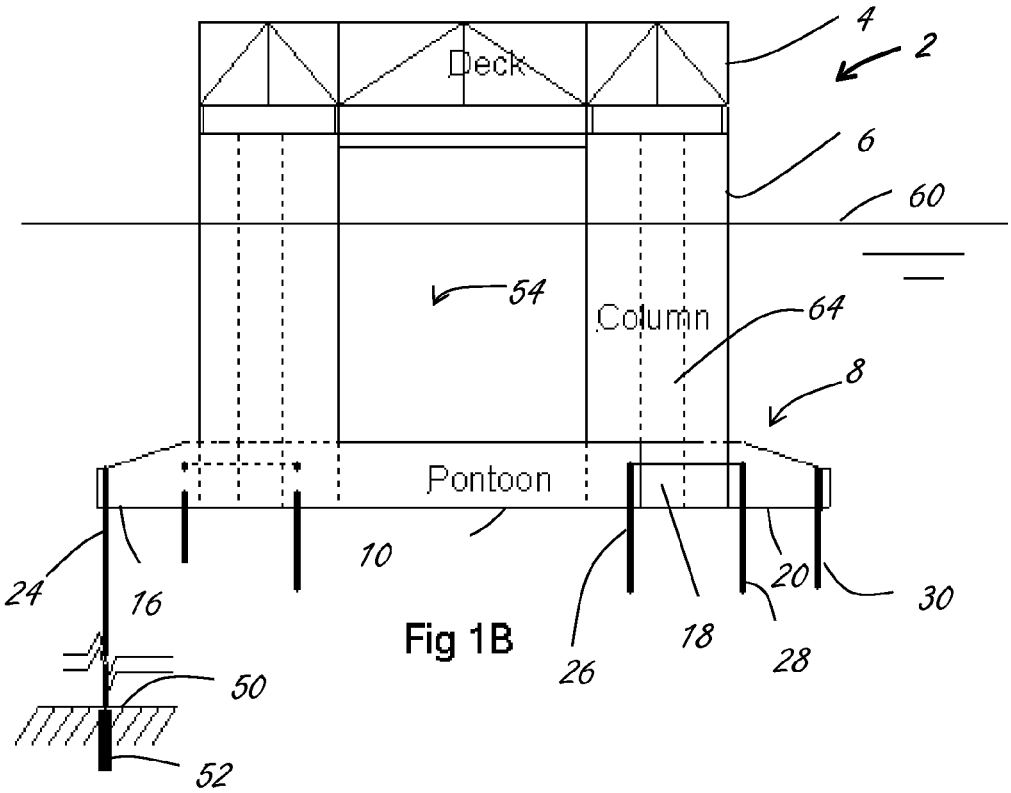
FIG. 1B is a schematic elevational view of the embodiment of FIG. 1A.

FIG. 1A is a schematic top view of an embodiment of the tension leg platform, illustrating pontoon extension portions for pontoons. FIG. 1B is a schematic elevational view of the embodiment of FIG. 1A. The figures will be described in conjunction with each other. The TLP 2 generally includes three major assemblies: a deck 4, one or more columns 6, and a pontoon base 8. The deck 4 is generally the uppermost assembly and is also known as a "topsides". The deck 4 supports the exploration equipment, production equipment, crew quarters, and other support facilities for the TLP. Production risers (not shown) can also be coupled to the deck after exploration and drilling has developed one or more wells below the TLP. The TLP 2 is shown floating in the water with a mean water line 60 and is anchored to a supporting surface 50, generally a sea bed, through tendons, such as tendon 24.

One or more columns 6 support the deck 4. In the exemplary embodiment shown, four columns are illustrated. However, the number of columns can vary from one to many. For structural reasons, often a TLP has three or four columns, with four columns providing a redundant member useful for supporting a planar structure, such as the deck. The columns can be circular, square, or other geometrical or cross-sectional shapes. Generally, columns are symmetrical in cross-sectional shape, but can vary. The columns are generally sealed and provide a buoyant structure for the TLP. In at least one embodiment of the present disclosure, the column locations are decoupled from the typical end of the pontoon, and the columns can be located at other positions on the pontoon base.

The pontoon base 8 advantageously includes at least three pontoons 10, 12, 14, and generally includes at least four pontoons with pontoon 15. The pontoons are coupled together at their respective intersection, such as intersection 34, and extend beyond the intersection. The length of the pontoon extending beyond the intersection could depend on cost, structural integrity, and other factors to balance the amount of increase of stability and resistance to adverse TLP movement. In typical TLPs, the pontoons end at the corners and the columns are at the corners, with the tendons being attached to the corners. However, in the present disclosure, the pontoons extend beyond the intersections to create pontoon extension portions 16, 18, 20 on ends of the pontoons 10, 12, 14, respectively. The pontoon extension portions are generally aligned in parallel with the pontoons from which they extend and provide additional buoyancy to the pontoons. A passageway 64 can extend from the deck 4 to the pontoon base 8 through the column 6. The direct load path between the main body of the pontoons themselves, their associated pontoon extension portions, and columns at the intersections of the pontoons provides improved strength and fatigue performance of the system compared to prior known TLPs.

In the exemplary embodiment, the pontoon extension portions are situated orthogonally to each other. In other embodiments, the extension portions could be situated at some non-orthogonal angle to each other. The extension portions provide additional buoyancy to the pontoon base at a location distal from the main body of the TLP and create additional stability due to the resulting force-distance moment arm. Further, the extended pontoons allow for a more distal coupling of the tendons to the pontoon base relative to the deck than is typical in existing TLPs. The pontoon extension portions are coupled to each other to provide additional structural integrity to the pontoon base. The additional coupling helps reduce a failure mode.

In some embodiments, the "freeboard" approaches 100 or more feet, where freeboard is the distance between the water level and the upper surface of the deck. Thus, the stability of the TLP during construction and assembly at a quayside location can be important. The extended pontoons disclosed herein can provide additional stability to the structure both as it is being built and then after deployment.

It is to be understood that variations can apply to the embodiments described herein. For example, a triangularly-shaped pontoon base with a triad of the extended pontoons could effectively result in six pontoon extension portions and support six, twelve, or more tendons, depending on the number of tendons per pontoon extension portion. As another example, the pontoon base could be formed in a hexagonal shape with six extended pontoons that can yield twelve pontoon extension portions and adapted to be coupled with twelve, twenty-four, or more tendons. Other variations are possible.

Generally, at least one tendon can be coupled to the pontoon extension portions. For example, in the exemplary embodiment, two tendons 22, 24 are coupled to the pontoon extension portion 16 of the pontoon 10, two tendons 26, 28 are coupled to the pontoon extension portion 18 of the pontoon 12, and two tendons 30, 32 are coupled to the pontoon extension portion 20 of the pontoon 14. In some embodiments, the number of tendons can be less or more than two tendons for each pontoon extension portion, where some embodiments of such are illustrated below. The tendons can be coupled to their respective pontoon extension portions through one or more coupling members. For example, the tendon 26 can be coupled to the pontoon extension portion 18 through the coupling member 42. The number of tendons per pontoon extension portion can vary from one to several as may be appropriate for the particular depth, TLP installation location, weight, size of the tendons and size of the TLP, and other factors as would be known to those with ordinary skill in the art given the disclosure herein. The tendons can be coupled to a supporting surface 50, such as sea bed, through an anchoring member 52, such as a piling.

The TLP 2 can further include a central open area 54. The open area 54 allows access from the deck through the TLP for exploration and production operations. Drill pipe, tools, and then risers and production pipe can be located through the open area 54.

Figure 2A:
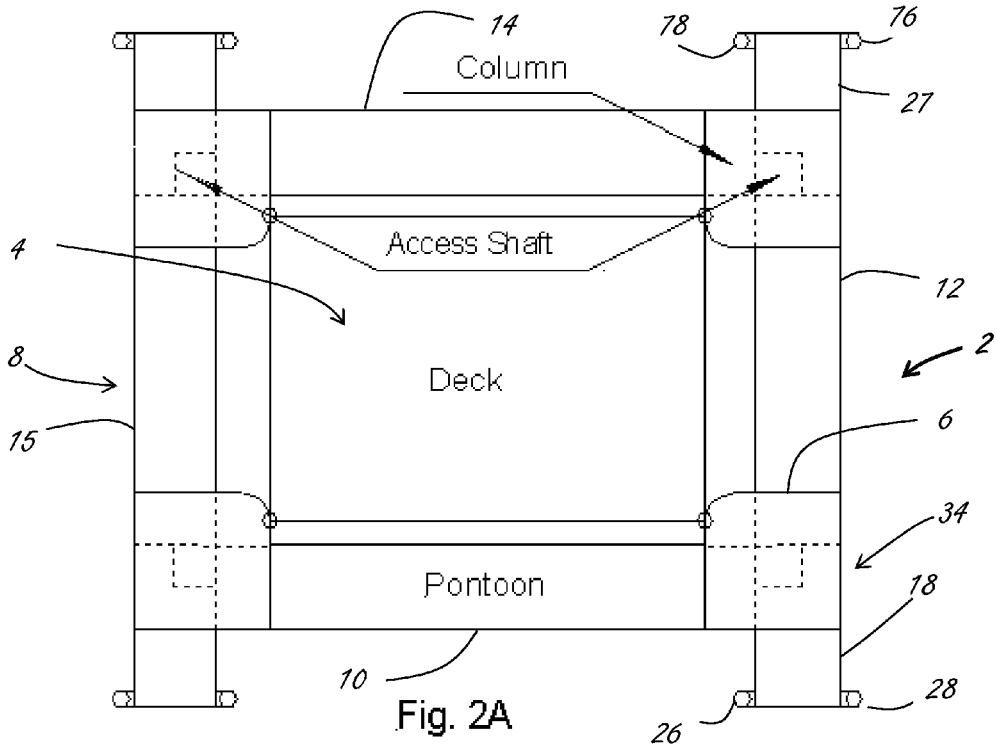
FIG. 2A is a schematic top view of another embodiment of the tension leg platform, illustrating pontoon extension portions for pontoons.
Figure 2B:
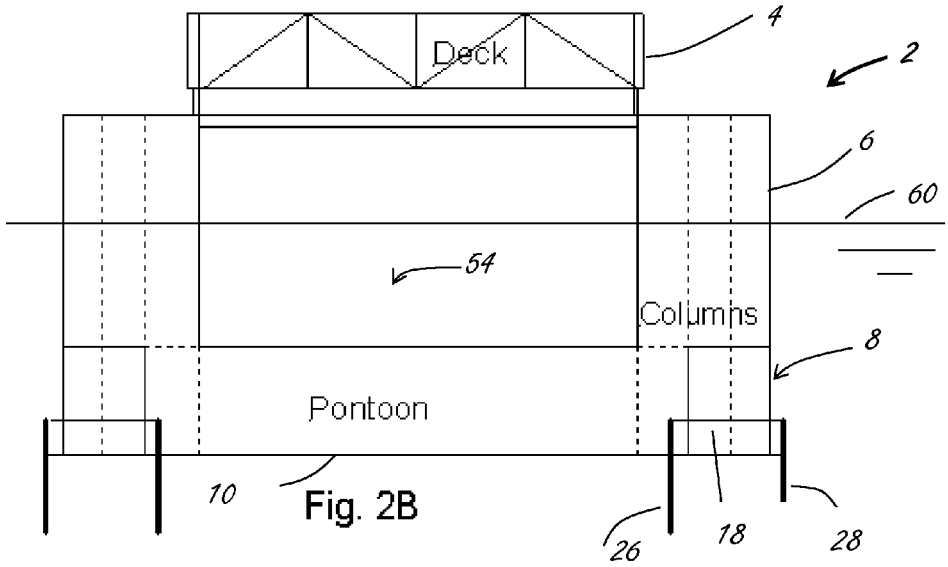
FIG. 2B is a schematic elevational view of the embodiment of FIG. 2A.

FIG. 2A is a schematic top view of another embodiment of the tension leg platform, illustrating pontoon extension portions for pontoons. FIG. 2B is a schematic elevational view of the embodiment of FIG. 2A. The figures will be described in conjunction with each other. Similar elements as has been described above are similarly numbered. The TLP 2 generally includes three major assemblies: a deck 4, one or more columns 6, and a pontoon base 8. The deck 4 is supported by one or more columns 6, which in turn is coupled to the pontoon base. The pontoon base 8 is illustrated with four pontoons 10, 12, 14, 15, but the number of pontoons can vary.

The pontoons are coupled together at their respective intersections, such as intersection 34, and extend beyond the intersection. In the illustrated embodiment, a subset of the pontoons extends beyond the intersections of the pontoons to create pontoon extension portions, such as the pontoon extension portions 18, 27 for the pontoon 12. Two tendons 26, 28 are coupled to the pontoon extension portion 18 of the pontoon 12, and two tendons 76, 78 are coupled to the pontoon extension portion 27 of the pontoon 12. The pontoon 15 can correspond to the pontoon 12 having pontoon extension portions, and tendons coupled thereto. The other two pontoons 10, 14 optionally may not extend beyond their respective intersections with the pontoons 12, 15.

Figure 3A:
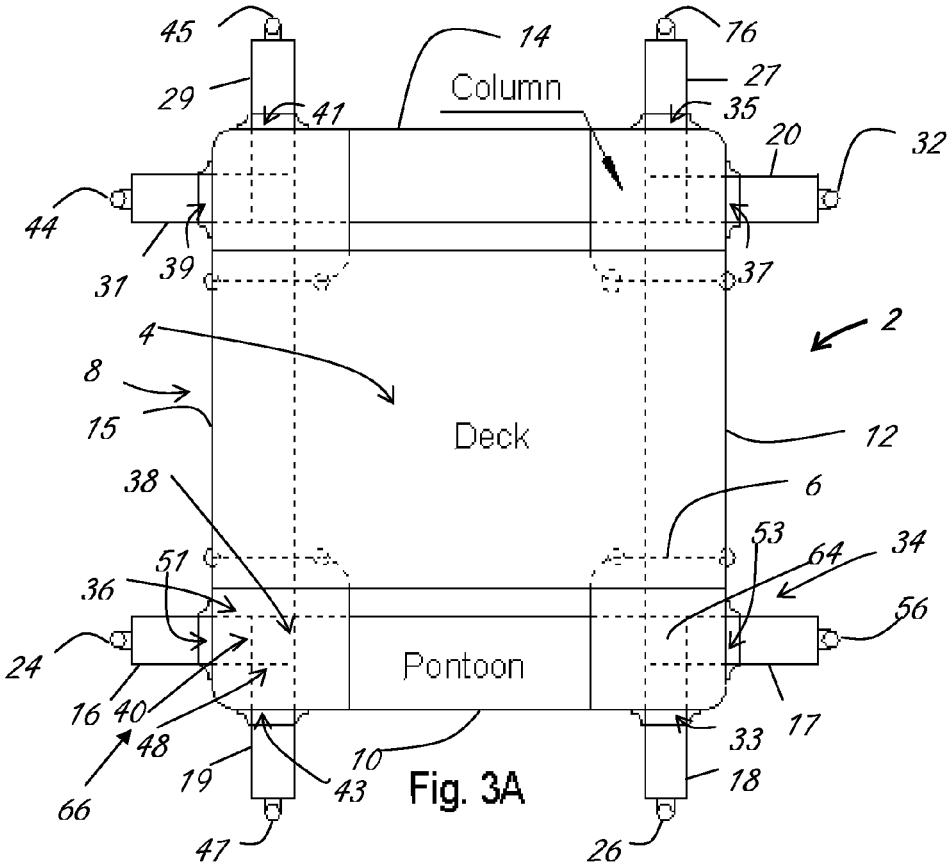
FIG. 3A is a schematic top view of another embodiment of the tension leg platform, illustrating pontoon extension portions for pontoons.
Figure 3B:
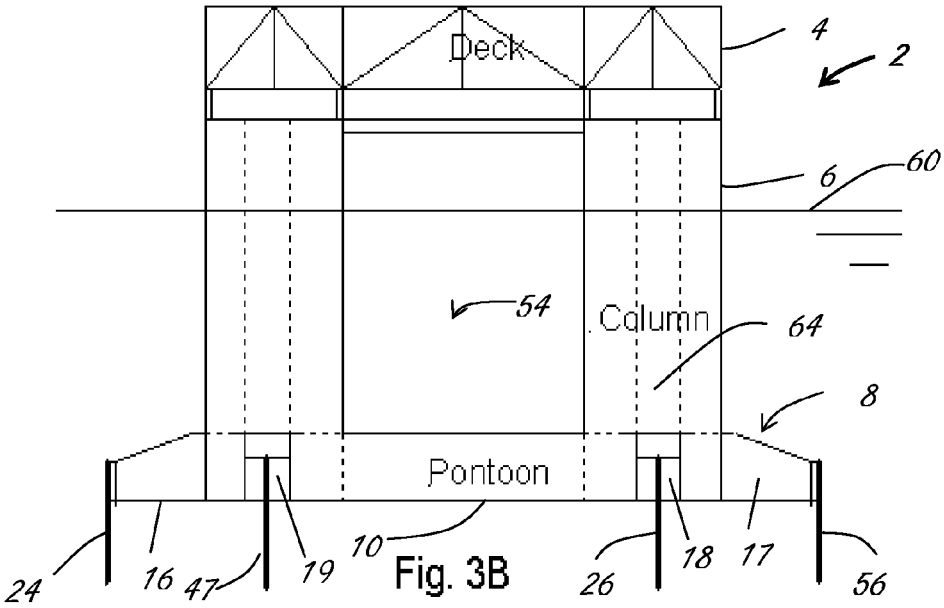
FIG. 3B is a schematic elevational view of the embodiment of FIG. 3A.
Figure 3C:
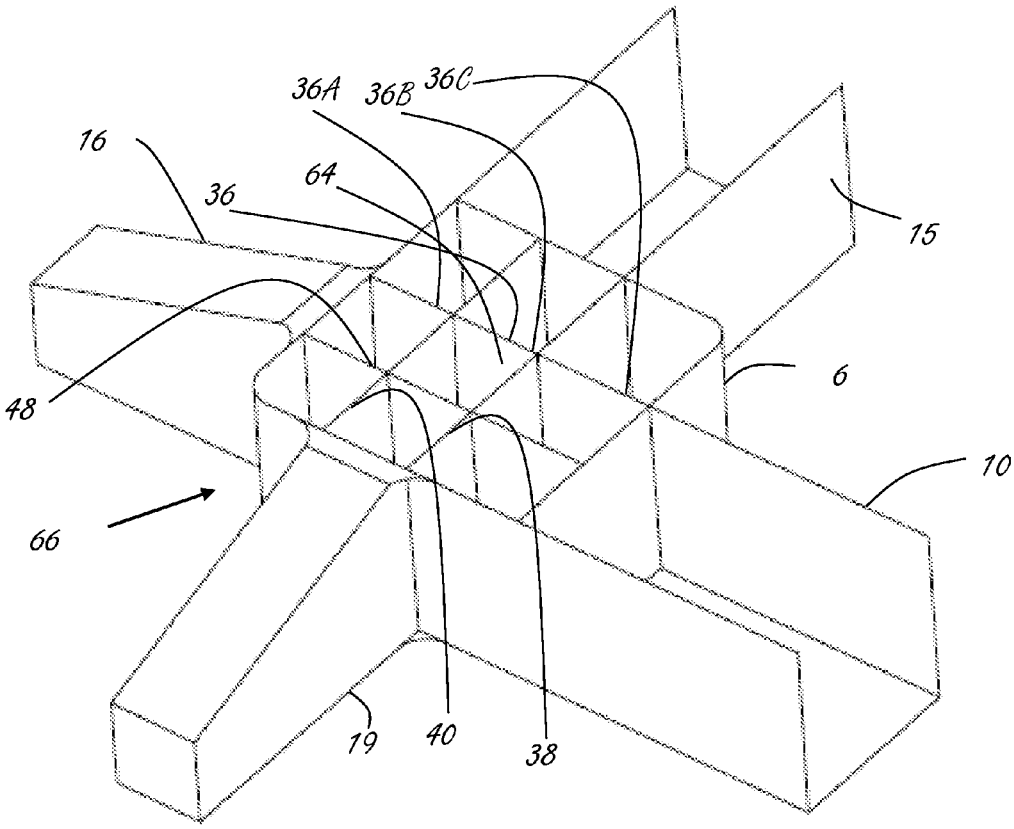
FIG. 3C is a schematic perspective view of a cross-section of the intersection of two pontoons, illustrating the pontoon extension portions of the embodiment of FIGS. 3A, 3B.

FIG. 3A is a schematic top view of another embodiment of the tension leg platform, illustrating pontoon extension portions for pontoons. FIG. 3B is a schematic elevational view of the embodiment of FIG. 3A. FIG. 3C is a schematic perspective view of a cross-section of the intersection of two pontoons, illustrating the pontoon extension portions of the embodiment of FIGS. 3A, 3B, where top plates of the pontoons and an upper portion of the column are removed for clarification. The figures will be described in conjunction with each other. Similar elements as has been described above are similarly numbered. The TLP 2 generally includes three major assemblies: a deck 4, one or more columns 6, and a pontoon base 8. The deck 4 is supported by one or more columns 6, which in turn is coupled to the pontoon base. The pontoon base 8 is illustrated with four pontoons 10, 12, 14, 15, but the number of pontoons can vary.

The pontoons are coupled together at their respective intersections, such as intersection 34, and extend beyond the intersections. In at least some embodiments, the pontoons extend beyond the intersections of the pontoons to create pontoon extension portions, such as the pontoon extension portions 18, 27 for the ends 33, 35, respectively, of the pontoon 12. A tendon 26 is coupled to the pontoon extension portion 18 of a first end 33 of the pontoon 12, and a tendon 76 is coupled to the pontoon extension portion 27 of a second end 35 of the pontoon 12. Similarly, the pontoon 14 includes a first pontoon extension portion 20 on a first end 37 of the pontoon and coupled to a tendon 32, and a second pontoon extension portion 31 on a second end 39 of the pontoon, and coupled to a tendon 44. The pontoon 15 includes a first pontoon extension portion 29 on a first end 41 of the pontoon and coupled to a tendon 45, and a second pontoon extension portion 19 on a second end 43 of the pontoon, and coupled to a tendon 47. The pontoon 10 includes a first pontoon extension portion 16 on a first end 51 of the pontoon and coupled to a tendon 24, and a second pontoon extension portion 17 on a second end 53 of the pontoon, and coupled to a tendon 56. This embodiment can reduce clash between two tendons on one pontoon extension portion, such as might more likely occur in the embodiments illustrated in FIGS. 1A, 1B and FIGS. 2A, 2B above, because there is only one tendon on each extension portion in FIGS. 3A-3C. The load on each extension portion can be reduced to half for a given size of extension portion compared with the embodiments of FIGS. 1A, 1B and FIGS. 2A, 2B. Therefore, this embodiment can yield higher fatigue and strength performance at the intersections between pontoon extension portions and columns.

The pontoon extension portions can generally extend from their respective pontoons by one or more intermediate members. For example, the pontoon 10 and the pontoon 15 intersect at an intersection 66. At the intersection 66, the pontoon extension portion 16 extends from its pontoon 10 by pontoon intermediate members 36, 48. The pontoon extension portion 19 extends from its pontoon 15 by pontoon intermediate members 38, 40. In turn, the pontoon intermediate members can be segmented in at least some embodiments into pontoon intermediate member portions as the intermediate members intersect other members, as illustrated in FIG. 3C. The pontoon intermediate member 36 can include a first pontoon intermediate member portion 36A, a second pontoon intermediate member portion 36B, and a third pontoon intermediate member portion 36C. The intermediate member portions 36A, 36B, 36C intersect the pontoon intermediate members 38, 40 and their intermediate member portions, if present. Further, the intermediate member portions can be used to align with a passageway 64 from the deck to the pontoon base 8 through the column 6.

An analysis comparing a typical TLP to the TLP disclosed herein was made to determine the effect of the pontoon extension portions on resistance to adverse movement (and thus increase the TLP stability) using one tendon per pontoon extension portion for ease of analysis, such as the embodiment shown in FIGS. 3A-3C. The analysis was based on the impact of a head storm and a quartering storm on the TLP. A head storm is characterized by a storm that impacts a structure with waves in a parallel direction against one of the sides. In at least one embodiment using exemplary dimensions of a typical TLP but with contemplated pontoon extension portions, the analysis shows that the TLP resistance rating is increased by about 20% for head storms. The resistance of the TLP of the present disclosure is even greater against quartering storms. A quartering storm is characterized by a storm that impacts a structure at an angle, such as a 45° angle, against a side of the structure. Using the same dimensions as above, the analysis shows that the TLP resistance rating is increased by about 35% for quartering storms. Further, an analysis was done with one tendon removed from the TLP, such as when a tendon as broken or no longer anchored. Using the same dimensions as above but with one tendon removed from the TLP, the analysis shows that the TLP resistance rating is increased by about 13% for head storms. Similarly, using the same dimensions as above, but with one tendon removed from the TLP, the analysis shows that the TLP resistance rating is increased by about 32% for quartering storms. Thus, conservatively, the TLP increases the resistance to movement by at least 10%.

Figure 4A:
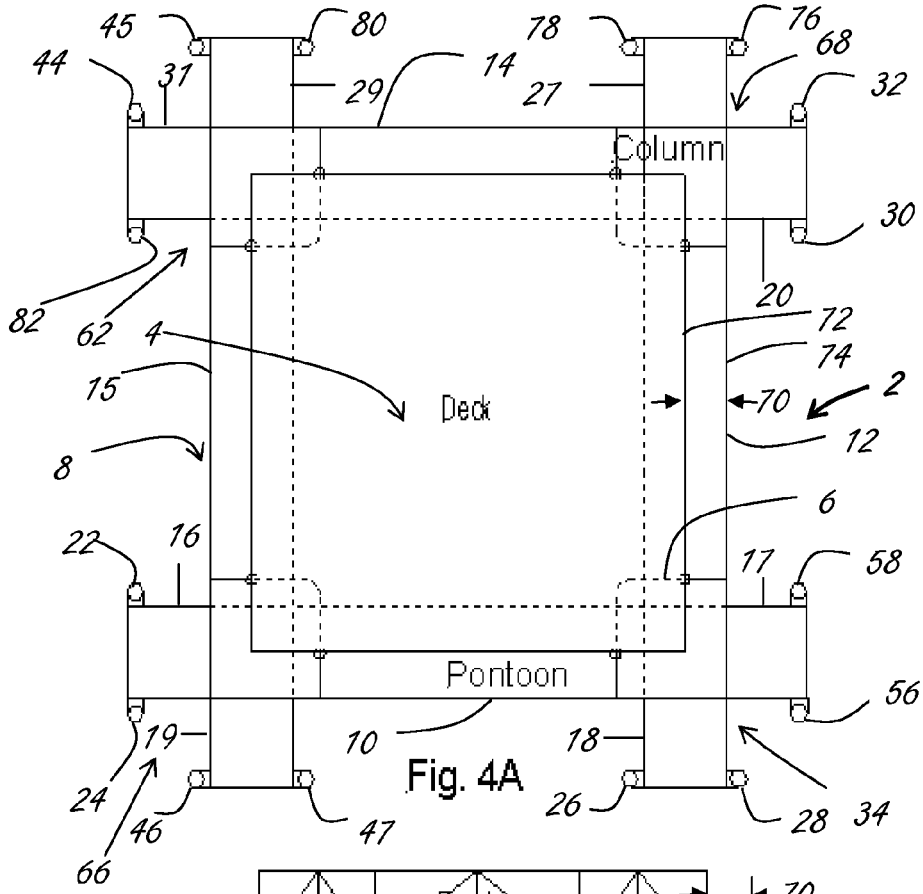
FIG. 4A is a schematic top view of another embodiment of the tension leg platform, illustrating pontoon extension portions for pontoons.
Figure 4B:
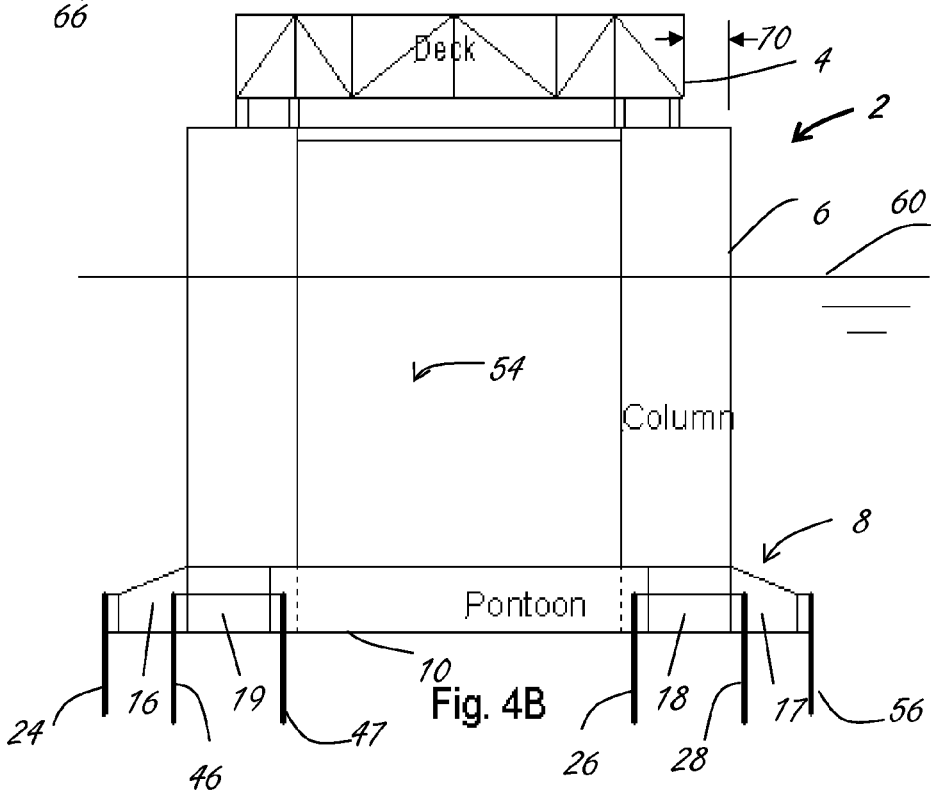
FIG. 4B is a schematic elevational view of the embodiment of FIG. 4A.

FIG. 4A is a schematic top view of another embodiment of the tension leg platform, illustrating pontoon extension portions for pontoons. FIG. 4B is a schematic elevational view of the embodiment of FIG. 4A. The figures will be described in conjunction with each other. Similar elements as has been described above are similarly numbered. The TLP 2 generally includes three major assemblies: a deck 4, one or more columns 6, and a pontoon base 8. The deck 4 is supported by one or more columns 6, which in turn is coupled to the pontoon base 8. The pontoon base 8 is illustrated with four pontoons 10, 12, 14, 15, but the number of pontoons can vary. The pontoons intersect with each other. For example, the pontoon 10 and the pontoon 12 intersect at an intersection 34. The pontoon 12 and the pontoon 14 intersect at an intersection 68. The pontoon 14 and the pontoon 15 intersect at an intersection 62. The pontoon 15 and the pontoon 10 intersect at an intersection 66. In at least this embodiment, the columns can be coupled to the pontoon base at the intersections. For example, a column 6 can be coupled with the pontoons 10, 12 at the intersection 34. However, such columnar location is not limiting, because the columns can be coupled at other locations on the pontoons than the intersections.

A deck periphery 72 can be designed to be smaller than a pontoon periphery 74 to establish a projected horizontal distance 70 between the smaller deck periphery and the pontoon periphery. A typical deck periphery extends over the columns at the intersections and is typically aligned on at least two sides with the pontoon periphery. Thus, the horizontal distance 70 of the illustrated embodiment is greater than a horizontal distance, if any, of a typically TLP and can provide greater stability to the TLP by increasing a horizontal distance from the deck periphery to the tendons.

In the illustrated and non-limiting embodiment, each intersection includes two extension portions and each extension portion is shown tethered with two tendons. For example, at intersection 66, an extension portion 16 is coupled to the pontoon 10 and tethered with tendons 22, 24, and an extension portion 19 is coupled to the pontoon 15 and tethered with tendons 46, 47. At intersection 34, an extension portion 17 is coupled to the pontoon 10 and tethered with tendons 56, 58, and an extension portion 18 is coupled to the pontoon 12 and tethered with tendons 26, 28. At intersection 68, an extension portion 20 is coupled to the pontoon 14 and tethered with tendons 30, 32, and an extension portion 27 is coupled to the pontoon 12 and tethered with tendons 76, 78. At intersection 62, an extension portion 29 is coupled to the pontoon 15 and tethered with tendons 45, 80, and an extension portion 31 is coupled to the pontoon 14 and tethered with tendons 44, 82.

This embodiment can be suitable for a larger and heavier deck 4 in deep water. There are sixteen tendons illustrated in FIG. 4A. Also, the TLP 2 could be designed with a combination of one tendon on one extension portion and two tendons on its adjacent extension portion to total twelve tendons.

Other and further embodiments utilizing one or more aspects of the inventions described above can be devised without departing from the spirit of Applicant's invention. For example, the number of pontoon and pontoon extension portions can vary, as well as the angle between adjacent pontoon extension portions. Further, pontoon extension portions can be continuous with the pontoon from which it extends or as a separate weldment generally in parallel alignment with the pontoon. Other variations are possible. Further, the various methods and embodiments of the TLP described herein can be included in combination with each other to produce variations of the disclosed methods and embodiments.

Further, the various methods and embodiments of the sensor system and methods herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for increased stability on a tension leg platform, comprising:

a deck adapted to support extraction of minerals for an offshore tension leg platform;

a column coupled with the deck;

a buoyant pontoon base of the tension leg platform coupled with the column and comprising a plurality of pontoons intersecting each other at a plurality of intersections and defining a pontoon periphery, the pontoons extending beyond the intersections to form a plurality of pontoon extension portions extending outwardly from the pontoon periphery and aligned in parallel with the respective pontoons from which the extension portions extend;

wherein the plurality of pontoons includes three or more pontoons;

one or more pontoon intermediate members extending between at least one of the pontoon extension portions and the pontoon from which it extends, the one or more pontoon intermediate members being disposed within the pontoon base;

wherein the plurality of intersections and the plurality of pontoon extension portions are equal; and wherein the pontoon extension portions are adapted to be coupled to one or more tendons extending between the pontoon extension portions and a supporting surface below the pontoon extension portions.

2. The system of claim 1, wherein the column is at least partially buoyant.

3. The system of claim 1, wherein the pontoon base comprises four pontoons orthogonally oriented to each other and four pontoon extension portions orthogonally oriented to each other.

4. The system of claim 1, wherein each pontoon extension portion is adapted to be coupled to a plurality of tendons.

5. The system of claim 1, wherein the pontoon extension portions extend beyond the pontoon periphery by at least 10% compared to a pontoon periphery without the pontoon extension portions.

6. The system of claim 1, wherein a plurality of columns are coupled with the pontoon base and the deck.

7. The system of 6, wherein the columns are disposed at a plurality of intersections formed from at least three intersecting pontoons.

8. The system of claim 1, wherein the deck has an outside periphery smaller than the pontoon periphery.

9. The system of claim 1, wherein pontoons that intersect each other define adjacent pontoons, and wherein the respective pontoon extension portions that extend parallel from the respective pontoons further extend non-parallel to the respective adjacent pontoons.

* * * * *